US007224210B2

(12) United States Patent
Garlapati et al.

(10) Patent No.: US 7,224,210 B2
(45) Date of Patent: May 29, 2007

(54) VOLTAGE REFERENCE GENERATOR CIRCUIT SUBTRACTING CTAT CURRENT FROM PTAT CURRENT

(75) Inventors: Akhil K. Garlapati, Boston, MA (US); David Pietruszynski, Austin, TX (US); Bruce P. Del Signore, Hollis, NH (US)

(73) Assignee: Silicon Laboratories Inc., Austin, TX (US)

( * ) Notice: Subject to any disclaimer, the term of this patent is extended or adjusted under 35 U.S.C. 154(b) by 120 days.

(21) Appl. No.: 10/877,288

(22) Filed: Jun. 25, 2004

(65) Prior Publication Data

US 2005/0285666 A1 Dec. 29, 2005

(51) Int. Cl.
*G05F 1/10* (2006.01)

(52) U.S. Cl. ..... 327/539

(58) Field of Classification Search ..... 323/312, 323/313; 327/512, 513, 534, 535, 537, 538, 327/539

See application file for complete search history.

(56) References Cited

U.S. PATENT DOCUMENTS 4,588,941 A 5/1986 Kerth et al.
4,857,823 A 8/1989 Bitting
5,001,362 A 3/1991 Tran
5,034,626 A * 7/1991 Pirez et al. ..... 327/542
5,132,556 A 7/1992 Cheng
5,349,286 A * 9/1994 Marshall et al. ..... 323/315
5,430,367 A 7/1995 Whitlock et al.
5,488,329 A 1/1996 Ridgers
5,568,045 A 10/1996 Koazechi
5,666,046 A 9/1997 Mietus
5,796,244 A 8/1998 Chen et al.
5,818,294 A * 10/1998 Ashmore, Jr. ..... 327/543
5,900,773 A 5/1999 Susak
5,949,225 A 9/1999 Sawtell
6,002,243 A * 12/1999 Marshall ..... 323/313
6,031,365 A 2/2000 Sharpe-Geisler
6,052,020 A 4/2000 Doyle
6,075,407 A 6/2000 Doyle
6,160,391 A 12/2000 Banba
6,366,071 B1 4/2002 Yu
6,727,744 B1 * 4/2004 Nagaya ..... 327/540
6,930,538 B1 * 8/2005 Chatal ..... 327/539

FOREIGN PATENT DOCUMENTS

JP 1292411 11/1989

OTHER PUBLICATIONS

Allen et al., "Current and Voltage References," *CMOS Analog Circuit Design*, 1987, pp. 240-252.

(Continued)

*Primary Examiner*—Jeffrey Zweizig
(74) *Attorney, Agent, or Firm*—Zagorin O'Brien Graham LLP

(57) ABSTRACT

A voltage reference generator generates a stable reference voltage that is less than the bandgap voltage of silicon for power supply voltages less than 2V, yet provides sufficient voltage headroom to operate a current mirror. In one embodiment, the voltage reference generator has a power supply rejection ratio of at least 60 dB and has comparable noise performance as compared to traditional bandgap cirucits. These advantages are achieved by subtracting a current proportional to a complement of an absolute temperature from a current proportional to the absolute temperature to generate a voltage having a positive temperature coefficient, which is then added to a voltage that is a complement of the absolute temperature to achieve a voltage that has a low temperature coefficient.

44 Claims, 2 Drawing Sheets

OTHER PUBLICATIONS

Allen et al., "CMOS Analog Circuits and Systems," *CMOS Analog Circuit Design*, 1987, pp. 589-599.

Banba et al., "A CMOS Bandgap Reference Circuit with Sub-1-V Operation," IEEE Journal of Solid-State Circuits, vol. 34, No. 5, May 1999, pp. 670-674.

de Langen et al., "Compact Low-voltage PTAT-Current Source and Bandgap-Reference Circuits," Delft Institute for MicroElectronics and Submicron technology (DIMES), pp. 108-111.

Gray et al., "Band-Gap-Referenced Biasing Circuits," *Analysis and Design of Analog Integrated Circuits*, Third Edition, 1993, pp. 338-346.

Lee, "Bandgap References in CMOS Technology," *The Design of CMOS Radio-Frequency Integrated Circuits*, 1998, pp. 233-235.

Razavi, "Bandgap Reference," *Design of Analog CMOS Integrated Circuits*, 2001, pp. 384-392.

Phang et al., "Low Voltage, Low Power CMOS Bandgap References," ECE 1352, University of Toronto, pp. 1-17.

* cited by examiner

VOLTAGE REFERENCE GENERATOR CIRCUIT SUBTRACTING CTAT CURRENT FROM PTAT CURRENT

CROSS-REFERENCE TO RELATED APPLICATION(S)

BACKGROUND

1. Field of the Invention

The present invention relates to generating a reference voltage in integrated circuits, and more particularly to reference voltage circuits for low-power applications.

2. Description of the Related Art

A bangap reference circuit has improved temperature stability and is less dependent on power supply voltage than other known voltage reference circuits. Bandgap reference circuits typically generate a reference voltage approximately equal to the bandgap voltage of silicon extrapolated to zero degrees Kelvin, i.e., $V_{G0}$=1.205V. Typical voltage reference circuits include a current mirror coupled to the power supply and the voltage reference node to provide a current proportional to the absolute temperature to the voltage reference node.

Integrated circuits having 3V power supplies can easily meet the demands of operating devices included in a cascoded current mirror and generate the reference voltage without compromising stability of the reference voltage. For example, a voltage reference generator with a power supply of 3V provides a reference voltage of 1.2V. The $V_{DS}$ of a MOSFET included in the current mirror has a magnitude of 3V−1.2V=1.8V, which is sufficient to operate the device under typical conditions with an acceptable power supply rejection ratio (PSRR) (i.e., the ability of the voltage reference generator to reject noise on the power supply). However, as the power supply voltage drops, e.g., for low-power applications, available voltage headroom required to operate the devices included in the current mirror is reduced, the PSRR becomes more critical, and the voltage reference generator is less likely to provide a sufficiently stable reference voltage with respect to variations on the power supply.

Accordingly, improved techniques for generating stable reference voltages for low-power applications are desired.

SUMMARY

A voltage reference generator generates a stable reference voltage that is less than the bandgap voltage of silicon for power supply voltages less than 2V, yet provides sufficient voltage headroom to operate a current mirror. In one embodiment, the voltage reference generator has a power supply rejection ratio of at least 60 dB and has a noise performance comparable to traditional bandgap circuits. These advantages are achieved by subtracting a current proportional to a complement of an absolute temperature from a current proportional to the absolute temperature to generate a voltage having a positive temperature coefficient, which is then added to a voltage that is a complement of the absolute temperature to achieve a voltage that has a low temperature coefficient.

In some embodiments of the present invention, an integrated circuit includes a first circuit and a second circuit that generate first and second currents, respectively. The first current is proportional to the absolute temperature. The second current is proportional to a complement of the absolute temperature. The integrated circuit further includes a node at which the second current is subtracted from the first current to generate a third current. The third current is proportional to an absolute temperature. The integrated circuit includes a third circuit that compensates for a temperature coefficient of the third current with a first voltage proportional to a complement of the absolute temperature. A reference voltage at the node is based at least in part on the third current and the first voltage. The temperature coefficient of the reference voltage is low.

In some embodiments of the present invention, a method for generating a reference voltage on a node of a circuit includes subtracting a current proportional to a complement of absolute temperature from a first current proportional to absolute temperature at a reference node. The subtracting generates a second current proportional to absolute temperature. The second current has a temperature coefficient more positive than the temperature coefficient of the first current. The method includes generating a first voltage proportional to absolute temperature across a resistor using the second current. The method further includes combining a second voltage proportional to a complement of absolute temperature with the first voltage to provide, at the reference node, a voltage having a low temperature coefficient.

In some embodiments of the present invention, a method of manufacturing an integrated circuit product includes forming a first circuit that generates a first current. The first current is proportional to an absolute temperature. The method includes forming a second circuit that generates a second current. The second current is proportional to a complement of the absolute temperature. The method includes forming a node at which the second current is subtracted from the first current to generate a third current. The third current is proportional to an absolute temperature. The method further includes forming a third circuit that compensates for a temperature coefficient of the third current with a first voltage proportional to a complement of the absolute temperature. A temperature coefficient of a reference voltage at the node is low. The reference voltage is based at least in part on the third current and the first voltage.

In some embodiments of the present invention, a voltage reference generator includes a resistor coupled to receive a first current. The first current is formed by subtracting a current proportional to a complement of an absolute temperature from a current proportional to the absolute temperature at a reference node, thereby generating a voltage proportional to absolute temperature across the resistor. The voltage reference generator includes a bipolar transistor coupled to the resistor and provides a voltage proportional to a complement of the absolute temperature to be combined with the voltage proportional to absolute temperature. The combination provides a reference voltage at the reference node. The reference voltage has a low temperature coefficient.

In some embodiments of the present invention, a method includes generating a first and second currents proportional to absolute temperature. The first current has a first temperature coefficient and the second current has a second temperature coefficient. The second temperature coefficient is greater than the first temperature coefficient. The method includes generating a reference voltage based on the first and second currents.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1:
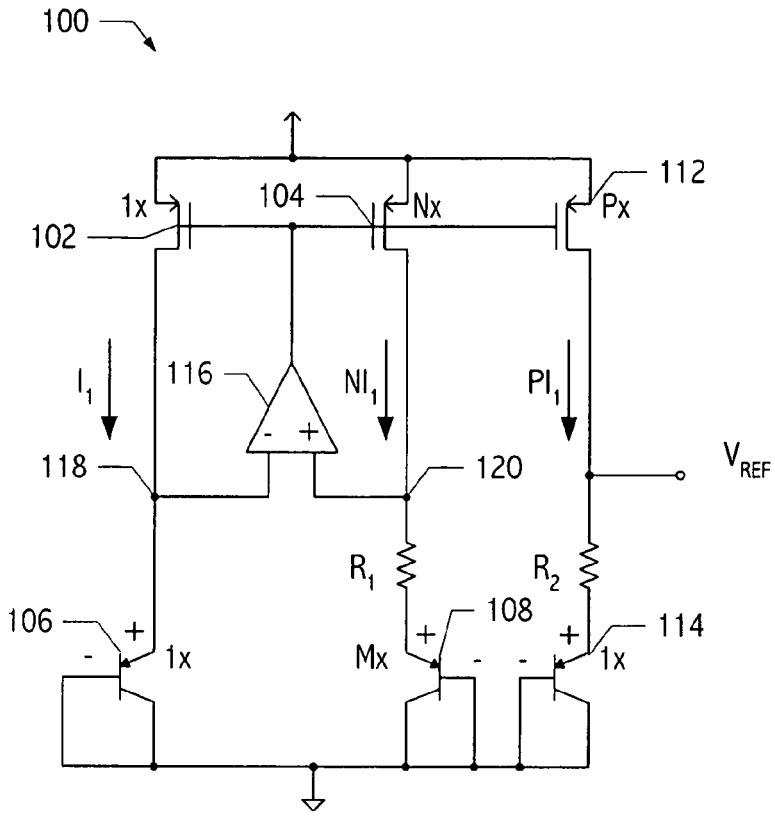
FIG. 1 illustrates a voltage reference generator circuit.

A typical voltage reference circuit (e.g., voltage reference generator 100 of FIG. 1) is designed to provide a temperature stable reference voltage (i.e., $V_{REF}$). In general, voltage reference circuits take advantage of two electrical characteristics to achieve the desired $V_{REF}$: the $V_{BE}$ of a bipolar transistor is nearly complementary to absolute temperature, e.g., $V_{BE}$=(−1.5 mV/°K*T+1.22)V, and $V_T$ is proportional to absolute temperature, i.e, $V_T$=kT/q.

A voltage proportional to absolute temperature (i.e., a 'ptat' voltage) may be obtained by taking the difference between two $V_{BE}$s biased at different current densities:

$$\Delta V_{BE} = V_T \ln\left(\frac{J_1}{J_2}\right),$$

where $J_1$ and $J_2$ are saturation currents of corresponding bipolar transistors. Accordingly, voltage reference circuit 100 includes a pair of pnp bipolar transistors (i.e., transistors 106 and 108) that are connected in a diode configuration (i.e., the collectors and bases of these transistors are coupled together) and coupled to ground. Transistor 108 has an emitter area that is M times larger than the area of transistor 106. Thus, the saturation currents of transistor 108 and transistor 106 vary by a factor of M. The emitter of transistor 106 is coupled to an inverting input of operational amplifier 116. The emitter of transistor 108 is coupled, via resistor $R_1$, to the non-inverting input of operational amplifier 116. Operational amplifier 116 maintains equivalent voltages at nodes 118 and 120, i.e., $V_{118}=V_{120}=V_{BE106}$. Hence, the difference between $V_{BE106}$ and $V_{BE108}$ (i.e., $\Delta V_{BE106,108}$) forms across resistor $R_1$. Operational amplifier 116 and transistors 102 and 104 convert this voltage difference into a current (i.e., current $I_1$) proportional to the voltage difference:

$$I_1 = \frac{\Delta V_{BE106,108}}{NR_1} = \frac{V_T \ln\left(\frac{M}{N}\right)}{NR_1}$$

Since the thermal voltage $V_T$ has a positive temperature coefficient of k/q, k=1.38*10$^{-23}$J/K and q=1.6*10$^{-19}$C, the current proportional to the voltage difference is proportional to an absolute temperature, i.e., $I_1$ is a 'ptat' current.

Transistor 114 provides a voltage nearly complementary to absolute temperature (i.e., a 'ctat' voltage) because the $V_{BE}$ of a bipolar transistor is nearly complementary to absolute temperature. By compensating the ptat current with a ctat voltage, transistors 102, 104, 106, 108, 112, and 114, and resistors $R_1$ and $R_2$, may be appropriately sized to generate a particular reference voltage output having a zero temperature coefficient:

$$\frac{V_{REF} - V_{BE114}}{R_2} = PI_1;$$

$$V_{REF} = V_{BE114} + PI_1 R_2;$$

$$V_{REF} = V_{BE114} + \frac{PR_2 V_T \ln\left(\frac{M}{N}\right)}{NR_1};$$

$$\frac{dV_{REF}}{dT} = \frac{dV_{BE114}}{dT} + \frac{PR_2 k \ln\left(\frac{M}{N}\right)}{NR_1 q}.$$

Setting $$\frac{dV_{REF}}{dT} = 0,$$

for $V_{REF}$ to have a zero temperature coefficient, $$\frac{PR_2 k \ln\left(\frac{M}{N}\right)}{NR_1 q} = -\frac{dV_{BE114}}{dT} = \frac{1.5\text{ mV}}{^\circ\text{K}}.$$

$V_{BE114}=V_{BE106}$=0.74 at 300° K for an exemplary process and choosing M=8, N=¼, P/N~4, and $R_2/R_1$~1.2:

$$V_{REF} = V_{BE114} + \frac{PR_2 V_T \ln\left(\frac{M}{N}\right)}{NR_1};$$

$$V_{REF} = 0.74\text{ V} + \frac{1.5\text{ mV}}{^\circ\text{K}} T;$$

at 300° K, $V_{REF}$=0.74V+0.45V=1.19V≈1.2V.

$V_{REF}$ is approximately equal to, $V_{G0}$=1.205V, i.e., the bandgap voltage of silicon extrapolated to zero degrees Kelvin.

When the power supply is 3V, the $V_{DS}$ of transistor 112 has a magnitude of 3V−1.2V=1.8V, which is sufficient to operate the device to provide a current independent of fluctuations in $V_{DS}$. Thus power supply noise will have a minimal effect on $I_1$. However, for an exemplary low-power application, the power supply voltage is 1.62V. Voltage reference generator 100 provides only a $V_{DS}$ of 0.42V for device 112. Transistor 112 may be operating in a linear/quasi-saturation current region and noise on the power supply will cause significant noise in $PI_1$, thereby generating a noisy $V_{REF}$ and degrading the accuracy of $V_{REF}$. The PSRR is typically determined empirically by presenting a varying signal on the power supply and measuring variations exhibited at the $V_{REF}$ node. At a 1.62V power supply, voltage reference generator 100 is unable to provide a desired 60 dB PSRR. The poor power supply rejection of voltage reference generator 100 makes voltage reference generator 100 inoperable for the purpose of providing a stable voltage reference. A desired voltage reference generator PSRR for a low-power application is at least 60 dB over process and temperature variations. In addition, noise from operational amplifier 116, which dominates the circuit noise of voltage reference generator 100, is amplified by a factor of $\sqrt{P}$ by the current mirror thus amplifying noise on $V_{REF}$.

Figure 2:
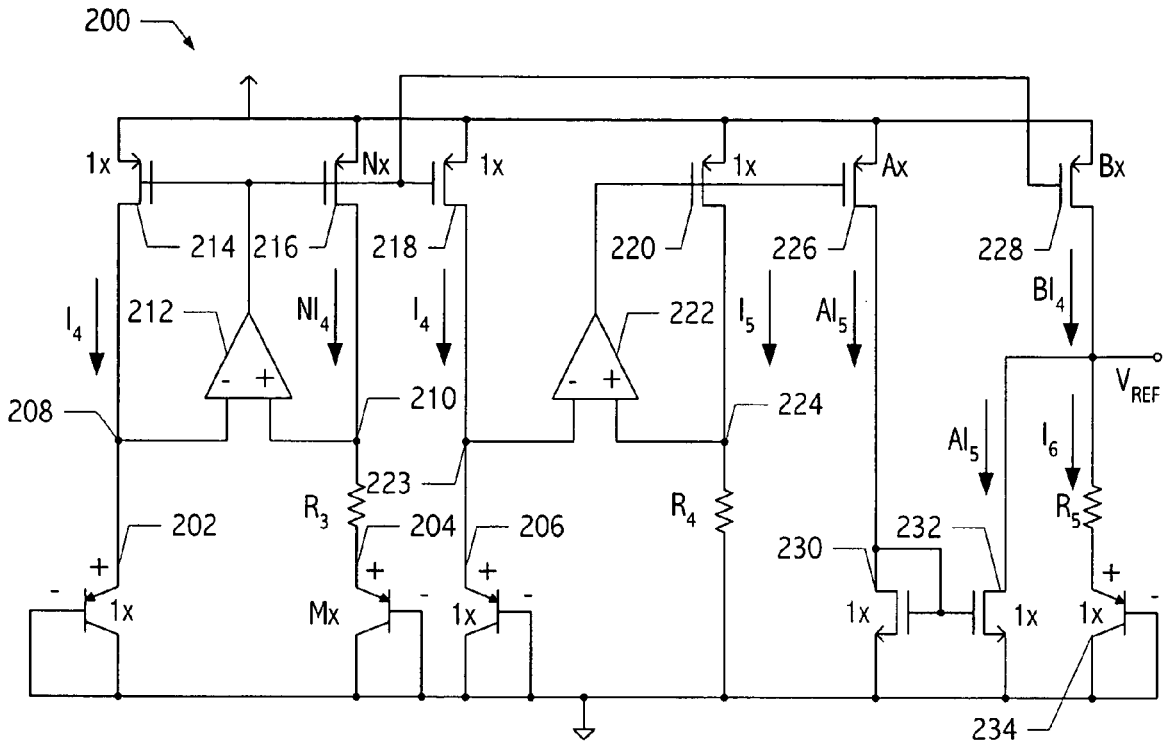
FIG. 2 illustrates a voltage reference generator circuit in accordance with some embodiments of the present invention.

Referring to FIG. 2, voltage reference generator 200 improves the power supply rejection ratio as compared to voltage reference generator 100, without increasing the noise performance, by subtracting a current complementary to absolute temperature from a current proportional to absolute temperature and by maintaining $V_{DS}$ of corresponding current mirror transistors to operate the current mirror transistors in a saturation region. Voltage reference circuit 200 includes a pair of pnp bipolar transistors (i.e., transistors 202 and 204) that are coupled in a diode configuration and coupled to ground. Transistor 204 has an emitter area that is M times larger than the area of transistor 202. Thus, transistor 204 has a current density that varies from the current density of transistor 202 by a factor of M. The emitter of transistor 202 is coupled to an inverting input of operational amplifier 212. The emitter of transistor 204 is coupled, via resistor $R_3$, to the non-inverting input of operational amplifier 212. Operational amplifier 212 maintains equivalent voltages at nodes 208 and 210, i.e., $V_{208}=V_{210}=V_{BE202}$. Hence, the difference between $V_{BE202}$ and $V_{BE204}$ (i.e., $\Delta V_{BE202,204}$) forms across resistor $R_3$. Operational amplifier 212 and transistors 214 and 216 convert this voltage difference into a current (i.e., current $I_4$) proportional to the voltage difference:

$$I_4 = \frac{\Delta V_{BE202,204}}{NR_3} = \frac{V_T \ln\left(\frac{M}{N}\right)}{NR_3}$$

Since the thermal voltage $V_T$ has a positive temperature coefficient of k/q, $k=1.38*10^{-23}$J/K and $q=1.6*10^{-19}$C, $I_4$, is a ptat current. Transistor 228 provides node $_{REF}$ with a mirrored $I_4$ current, amplified by B.

Transistor 206 provides a ctat voltage because the $V_{BE}$ of a pnp bipolar transistor is nearly complementary to absolute temperature. The emitter of transistor 206 is coupled to an inverting input of operational amplifier 222. The resistor $R_4$ is coupled to the non-inverting input of operational amplifier 222. Operational amplifier 222 maintains equivalent voltages at nodes 223 and 224, i.e., $V_{223}=V_{224}=V_{BE206}$. Hence, a ctat current proportional to $V_{BE206}$ flows through resistor $R_4$:

$$I_5 = \frac{V_{BE206}}{R_4}.$$

Transistors 226, 230, and 232 form mirror current $I_5$ with a gain of A, thus, providing a ctat current $AI_5$ that is subtracted from $BI_4$ at node $V_{REF}$.

Transistor 234 provides a ctat voltage because the $V_{BE}$ of bipolar transistor is nearly complementary to absolute temperature. By subtracting a ctat current from a ptat current and compensating for a remaining ptat current with a ctat voltage, transistors 214, 216, 202, 204, 218, 206, 220, 226, 228, 230, and 234, and resistors $R_3$, $R_4$, and $R_5$, may be appropriately sized to generate a particular reference voltage output, $V_{REF}$, having a low (e.g., substantially zero) temperature coefficient (e.g., less than 1 μV/° K over a given temperature range):

$$BI_4 = \frac{V_{REF} - V_{BE234}}{R_5} + \frac{AV_{BE206}}{R_4};$$

$$V_{REF} = BI_4R_5 + V_{BE234} - \frac{AR_5V_{BE206}}{R_4};$$

$$I_4 = \frac{V_T \ln\left(\frac{M}{N}\right)}{NR_3}.$$

Choosing M=8 and N=1/4, $$I_4 = \frac{4V_T\ln(32)}{R_3}.$$

$$\text{at } 300^\circ \text{ K, } V_{234} \approx V_{206} \approx 0.74\ V;$$

$$\frac{dV_{BE3}}{dT} \approx \frac{dV_{BE4}}{dT} \approx -1.5\frac{\text{mV}}{^\circ\text{K}}.$$

Choosing A=1/4, B=3/2;

$$V_{REF} = 6V_T\frac{R_5}{R_3}\ln(32) - \left(\frac{1}{4}\right)\frac{R_5}{R_4}V_{BE206} + V_{BE234}.$$

Setting $$\frac{dV_{REF}}{dT} = 0,$$

for $V_{REF}$ to have a zero temperature coefficient, $$\frac{dV_{REF}}{dT} = 6\frac{k}{q}\frac{R_5}{R_3}\ln(32) + \left(\frac{1}{4}\right)\frac{R_5}{R_4}1.5*10^{-3} - 1.5*10^{-3};$$

$$4.8\frac{R_5}{R_3} + \frac{R_5}{R_4} = 4.$$

For currents $AI_5$ and $I_6$ to be positive, $$BI_4 > A\frac{V_{BE206}}{R_4};$$

$$6V_T\ln 32\frac{R_5}{R_3} > \left(\frac{1}{4}\right)V_{BE206}\frac{R_5}{R_4};$$

$$\frac{R_4}{R_3} > \frac{1.22 - 1.5*10^{-3}T}{7.17*10^{-3}T}.$$

Evaluating over a temperature range (e.g., −55° C.<T<125° C.), at −55° C. (i.e., T=218° K), $$\frac{R_4}{R_3} > 0.5713, \text{ and}$$

at 125° C.(i.e., $T$ = 398° K), $$\frac{R_4}{R_3} > 0.2183.$$

Therefore, $\frac{R_4}{R_3} > 0.5713$.

Also, $$\frac{R_5}{R_4} = 4 - 4.8\frac{R_5}{R_3} > 0$$

for the ratio of the two resistors to be positive;

$$\frac{R_5}{R_3} < \frac{4}{4.8} = 0.833.$$

$$V_{REF} = 6V_T\frac{R_5}{R_3}\ln(32) - \left(\frac{1}{4}\right)\frac{R_5}{R_4}V_{BE206} + V_{BE234}.$$

Assuming $V_{BE206}=V_{BE234}=V_{BE}$, $$V_{REF} = 6V_T\frac{R_5}{R_3}\ln 32 + \left(1 - \left(\frac{1}{4}\right)\frac{R_5}{R_4}\right)V_{BE}$$

$$V_{REF} = 6V_T\frac{R_5}{R_3}\ln 32 + \left(1 - \left(\frac{1}{4}\right)\frac{R_5}{R_4}\right)(1.22 - 1.5*10^{-3}T)$$

Substituting $$\frac{R_5}{R_4} = 4 - 4.8\frac{R_5}{R_3},$$

$$V_{REF} = 6V_T\frac{R_5}{R_3}\ln 32 + \left(1 - 1 + 1.2\frac{R_5}{R_3}\right)(1.22 - 1.5*10^{-3}T);$$

$$V_{REF} = 1.8*10^{-3}\frac{R_5}{R_3}T + \left(1.464\frac{R_5}{R_3}\right) - 1.8*10^{-3}\frac{R_5}{R_3}T;$$

$$V_{REF} = 1.464\frac{R_5}{R_3}.$$

Since $\frac{R_5}{R_3} < \frac{4}{4.8} = 0.833$, $$V_{REF} < 1.22V.$$

However, $\frac{R_4}{R_3} > 0.5713$ and $$\frac{R_5}{R_4} < \frac{R_5}{0.5713R_3};$$

$$\frac{R_5}{R_4} + 4.8\frac{R_5}{R_3} < \frac{R_5}{0.5713R_3} + 4.8\frac{R_5}{R_3}.$$

From above, $$\frac{R_5}{R_4} + 4.8\frac{R_5}{R_3} = 4;$$

$$\frac{R_5}{0.5713R_3} + 4.8\frac{R_5}{R_3} > 4;$$

$$\frac{R_5}{R_3} > 0.61.$$

$$V_{REF}>(1.464)0.61=0.893V.$$

Hence, $0.893V<V_{REF}<1.22V$.

Choosing $V_{REF}$=0.96V, in one embodiment of the present invention, $R_3$=7.5 kΩ, $R_4$=5.28 kΩ, $R_5$=4.82 kΩ. The values given above are exemplary. Other values (e.g., resistances and transistor sizes) may be selected to obtain an appropriate voltage reference in a given environment.

Voltage reference generator 200 provides reference voltages less than 1.0V (e.g., 0.96V) by subtracting a ctat current $AI_5$ from ptat current $BI_4$ to generate a current proportional to absolute temperature having a temperature coefficient more positive than the temperature coefficient of $BI_4$. A current having a temperature coefficient greater than the temperature coefficient of $BI_4$ may also be achieved by adding a ptat current to B $I_4$ to form $I_6$. As described above, the reference voltage of voltage reference generator 100 is $$V_{REF} = V_{BE114} + \frac{PR_2V_T\ln\left(\frac{M}{N}\right)}{NR_1},$$

which may be modeled as $$V_{REF}=V_{BE}+C_1R_2T.$$

The reference voltage of voltage reference generator 200 is $$V_{REF} = V_{BE234} + R_5(BI_4 - AI_5)$$

$$V_{REF} = V_{BE234} + R_5\left(\frac{BV_T\ln\left(\frac{M}{N}\right)}{NR_3} - \frac{AV_{BE206}}{R_4}\right)$$

$$V_{REF} = V_{BE234} + R_5\left(\frac{B4V_T\ln 32}{R_3}\right) + R_5\frac{A(1.5\text{mV}/^\circ KT)}{R_4} - R_5\frac{1.22V}{R_4}\Bigg),$$

which may be modeled as $$V_{REF}=V_{BE}+C_2R_5T+C_3R_5.$$

Since $C_2$ (i.e., the slope of current $I_6$ with respect to temperature) is greater than $C_1$ (i.e., the slope of current $I_1$ with respect to temperature), to maintain a constant voltage with respect to temperature, resistor $R_5$ is smaller than $R_2$. However, $C_3$, i.e., the offset of ptat current $I_6$, is negative, thus reducing the reference voltage produced by voltage reference generator 200 from that produced by voltage reference generator 100 (e.g., below 1.2V). The increase in the temperature coefficient of $I_6$ and the offset of current $I_6$ allows reducing $V_{REF}$ below 1.2V while maintaining a substantially zero temperature coefficient of $V_{REF}$. The increase in the temperature coefficient of $I_6$ also allows reducing B, which reduces noise contributions from operational amplifier 212 at $V_{REF}$. A smaller B also results in transistor 228 operating farther from its linear/quasi-saturation region.

The reduction in $V_{REF}$ from 1.2V improves the PSRR because the voltage headroom for the current mirror is at least 1.62V−0.96V=0.66V. Noise performance of voltage reference generator 200 is similar to that for voltage reference generator 100 because the noise from operational amplifier 222 is attenuated by A, thus the dominant noise component is from operational amplifier 212. Ptat current $I_6$ has a greater slope as a function of temperature than ptat current $BI_4$. The exemplary embodiment of circuit 200 was designed for a supply voltage of 1.62V and a reference voltage of 0.96V, however, this circuit is not limited thereto. Voltage reference generator 200 may be operated at other supply voltages and reference voltages, and remains operable so long as $V_{DD}-V_{REF}>400$ mV (i.e., the current mirror remains operable) and $1.22V>V_{REF}>0.893V$.

While circuits and physical structures are generally presumed, it is well recognized that in modern semiconductor design and fabrication, physical structures and circuits may be embodied in computer readable descriptive form suitable for use in subsequent design, test, or fabrication stages. Structures and functionality presented as discrete components in the exemplary configurations may be implemented as a combined structure or component. The invention is contemplated to include circuits, systems of circuits, related methods, and computer-readable medium encodings of such circuits, systems, and methods, all as described herein, and as defined in the appended claims. As used herein, a computer readable medium includes at least disk, tape, or other magnetic, optical, semiconductor (e.g., flash memory cards, ROM), or electronic medium and a network, wireline, wireless or other communications medium.

What is claimed is:

1. An integrated circuit comprising:

a first circuit, the first circuit for generating a first current, the first current being proportional to an absolute temperature;

a second circuit, the second circuit for generating a second current, the second current being proportional to a complement of the absolute temperature; and a node at which the second current is subtracted from the first current to generate a third current, the third current being proportional to an absolute temperature; and a third circuit, the third circuit for compensating for a temperature coefficient of the third current with a first voltage proportional to a complement of the absolute temperature; and wherein a temperature coefficient of a reference voltage at the node is low, the reference voltage being based at least in part on the third current and the first voltage.

2. The integrated circuit, as recited in claim 1, wherein a temperature coefficient of the third current is more positive than a temperature coefficient of the first current.

3. The integrated circuit, as recited in claim 1, wherein the third current includes an offset component independent of temperature.

4. The integrated circuit, as recited in claim 1, wherein the first circuit comprises two bipolar transistors operating at different current densities.

5. The integrated circuit, as recited in claim 1, wherein the second circuit comprises a bipolar transistor providing a voltage with a negative temperature coefficient.

6. The integrated circuit, as recited in claim 1, wherein the third circuit comprises a bipolar transistor providing a voltage with a negative temperature coefficient.

7. The integrated circuit, as recited in claim 1, wherein the subtracting reduces the reference voltage on the node below a bandgap voltage.

8. The integrated circuit, as recited in claim 1, wherein the low temperature coefficient of the reference voltage is approximately zero.

9. The integrated circuit, as recited in claim 1, wherein the reference voltage satisfies the relationship $0.893V<V<1.22V$.

10. The integrated circuit, as recited in claim 9, wherein the reference voltage is less than 1.0V.

11. The integrated circuit, as recited in claim 9, wherein the reference voltage is measured with reference to ground.

12. The integrated circuit, as recited in claim 1, wherein the power supply rejection ratio is at least 60 dB.

13. The integrated circuit, as recited in claim 1, wherein the first circuit comprises a first operational amplifier maintaining effective equivalence of voltages on a first node and a second node of the first circuit and the second circuit comprises a second operational amplifier maintaining effective equivalence of voltages on a first node and a second node of the second circuit.

14. The integrated circuit, as recited in claim 1, wherein the first circuit comprises a first current mirror coupled to the voltage reference node, the first current mirror amplifying a current proportional to absolute temperature to supply the first current.

15. The integrated circuit, as recited in claim 14, wherein the second circuit comprises a second current minor coupled to the voltage reference node, the second current minor attenuating a current proportional to a complement of absolute temperature to supply the second current.

16. The integrated circuit, as recited in claim 15, wherein the second current mirror attenuates noise contributed by an operational amplifier maintaining effective equivalence of voltages on a first node and a second node of the second circuit.

17. The integrated circuit, as recited in claim 1, wherein noise on the voltage reference node is predominately noise from an operational amplifier maintaining effective equivalence of voltages on a first node and a second node of the first circuit.

18. A method for generating a reference voltage on a node of a circuit comprising:

subtracting a current proportional to a complement of absolute temperature from a first current proportional to absolute temperature at a reference node to generate a second current proportional to absolute temperature having a temperature coefficient more positive than the temperature coefficient of the first current;

generating a first voltage proportional to absolute temperature across a resistor using the second current; and combining a second voltage proportional to a complement of absolute temperature with the first voltage to provide at the reference node a voltage having a low temperature coefficient.

19. The method, as recited in claim 18, further comprising:

operating two bipolar transistors at different current densities to generate the first current.

20. The method, as recited in claim 18, further comprising:

maintaining substantial equivalence of a voltage on a first node and a voltage on a second node with a first operational amplifier, the first and second nodes being used to generate the first current.

21. The method, as recited in claim 20, further comprising:

maintaining substantial equivalence of a voltage on a third node and a voltage on a fourth node with a second operational amplifier, the third and fourth nodes being used to generate the current proportional to a complement of absolute temperature.

22. The method, as recited in claim 21, further comprising:

attenuating noise from the second operational amplifier affecting the voltage reference node by attenuating a mirrored current.

23. The method, as recited in claim 18, wherein the subtracting reduces the voltage to be less than a bandgap voltage.

24. The method, as recited in claim 20, wherein noise on the voltage reference node is predominately noise from the first operational amplifier.

25. A computer readable medium encoding a description of an integrated circuit product comprising:

a first circuit, the first circuit (hr generating a first current, the first current being proportional to an absolute temperature;

a second circuit, the second circuit for generating a second current, the second current being proportional to a complement of the absolute temperature; and a node at which the second current is subtracted from the first current to generate a third current, the third current being proportional to an absolute temperature; and a third circuit, the third circuit for compensating for a temperature coefficient of the third current with a first voltage proportional to a complement of the absolute temperature; and wherein a temperature coefficient of a reference voltage at a voltage reference node is low, the reference voltage being based at least in part on the third current and the first voltage.

26. A method of manufacturing an integrated circuit product, the method comprising:

forming a first circuit, the first circuit for generating a first current, the first current being proportional to an absolute temperature;

forming a second circuit, the second circuit for generating a second current, the second current being proportional to a complement of the absolute temperature; and forming a node at which the second current is subtracted from the first current to generate a third current, the third current being proportional to an absolute temperature; and forming a third circuit, the third circuit for compensating for a temperature coefficient of the third current with a first voltage proportional to a complement of the absolute temperature; and wherein a temperature coefficient of a reference voltage at the node is low, the reference voltage being based at least in part on the third current and the first voltage.

27. The method, as recited in claim 26, wherein a temperature coefficient of the third current is more positive than a temperature coefficient of the first current.

28. The method, as recited in claim 26, wherein the third current includes an offset component independent of temperature.

29. The method, as recited in claim 26, wherein the first circuit comprises two bipolar transistors operating at different current densities.

30. The method, as recited in claim 26, wherein the second circuit comprises a bipolar transistor providing a voltage with a negative temperature coefficient.

31. The method, as recited in claim 26, wherein the third circuit comprises a bipolar transistor providing a voltage with a negative temperature coefficient.

32. The method, as recited in claim 26, wherein the subtracting reduces the reference voltage at the voltage reference node to be less than a bandgap voltage.

33. The method, as recited in claim 26, wherein the first circuit comprises a first current mirror coupled to the voltage reference node, the first current mirror amplifying the first current.

34. The method, as recited in claim 33, wherein the second circuit comprises a second current mirror coupled to the voltage reference node, the second current mirror attenuating the second current.

35. A voltage reference generator comprising:

a resistor coupled to receive a first current, the first current being formed by subtracting a current proportional to a complement of an absolute temperature from a current proportional to an absolute temperature at a reference node, thereby generating a voltage proportional to absolute temperature across the resistor; and a bipolar transistor coupled to the resistor and coupled to provide a voltage proportional to a complement of the absolute temperature tat combined with the voltage proportional to absolute temperature provides a reference voltage at the reference node having a low temperature coefficient.

36. The voltage reference generator, as recited in claim 35, wherein a temperature coefficient of the first current is more positive than a temperature coefficient of the current proportional to absolute temperature.

37. The voltage reference generator, as recited in claim 35, wherein the first current includes an offset component independent of temperature.

38. The voltage reference generator, as recited in claim 35, wherein the reference voltage is below a bandgap voltage.

39. The voltage reference generator, as recited in claim 38, wherein the reference voltage is 1.0V.

40. An apparatus comprising:

means for generating a first current, the first current being proportional to an absolute temperature;

means for generating a second current, the second current being proportional to a complement of the absolute temperature; and means for subtracting the second current from the first current to generate a third current, the third current having a temperature coefficient more positive than the temperature coefficient of the first current; and means for compensating for a positive temperature coefficient of the third current to generate a voltage on a node having a low temperature coefficient.

41. The apparatus, as recited in claim 40, comprising:

means for attenuating noise from the means for generating the second current.

42. A method for generating a reference voltage on a node of a circuit comprising:

generating a first current proportional to absolute temperature, the first current having a first temperature coefficient;

generating a second current proportional to absolute temperature, the second current having a second temperature coefficient, the second temperature coefficient being greater than the first temperature coefficient; and generating a reference voltage based on the first and second currents, wherein the second current includes an offset component, the offset component being substantially independent of temperature.

43. The method, as recited in claim 42, wherein the reference voltage is less than a bandgap voltage.

44. The method, as recited in claim 42, wherein the second current is the difference between the first current and a third current, the third current being proportional to a complement of absolute temperature.

* * * * *

UNITED STATES PATENT AND TRADEMARK OFFICE

CERTIFICATE OF CORRECTION

PATENT NO. : 7,224,210 B2
APPLICATION NO. : 10/877288
DATED : May 29, 2007
INVENTOR(S) : Akhil K. Garlapati, David Pietruszynski and Bruce P. Del Signore It is certified that error appears in the above-identified patent and that said Letters Patent is hereby corrected as shown below:

On the Title page add under (56) References Cited, U.S. PATENT DOCUMENTS:
5,563,502 A 10/1996 Akioka et al.
6,198,267 B1 03/2001 Bakker et al.
6,799,889 B2 10/2004 Pennock Col. 10, line 32, please replace “current minor” with --current mirror--
Col. 10, line 33, please replace “current minor” with --current mirror--
Col. 11, line 23, please replace “circuit (hr” with --circuit for--

Signed and Sealed this

Eleventh Day of September, 2007

JON W. DUDAS
*Director of the United States Patent and Trademark Office*